US009416532B2

(12) United States Patent
Kang et al.

(10) Patent No.: US 9,416,532 B2
(45) Date of Patent: Aug. 16, 2016

(54) INTERIOR SOUND ABSORPTION SHEET AND SOUND ABSORBING SOUND-PROOFING PANEL CONTAINING SAME

(71) Applicant: LG Hausys, Ltd., Seoul (KR)

(72) Inventors: Gil-Ho Kang, Gunpo-si (KR); Seong-Moon Jung, Daejeon (KR); Bong-Gyu Kang, Seoul (KR)

(73) Assignee: LG HAUSYS, LTD., Seoul (KR)

( * ) Notice: Subject to any disclaimer, the term of this patent is extended or adjusted under 35 U.S.C. 154(b) by 0 days.

(21) Appl. No.: 14/412,249

(22) PCT Filed: Jun. 25, 2013

(86) PCT No.: PCT/KR2013/005580
§ 371 (c)(1),
(2) Date: Dec. 31, 2014

(87) PCT Pub. No.: WO2014/007481
PCT Pub. Date: Jan. 9, 2014

(65) Prior Publication Data

US 2015/0184374 A1 Jul. 2, 2015

(30) Foreign Application Priority Data

Jul. 5, 2012 (KR) ..... 10-2012-0073358

(51) Int. Cl.
*E04B 1/82* (2006.01)
*E04B 1/84* (2006.01)
*G10K 11/172* (2006.01)

(52) U.S. Cl.
CPC ..... *E04B 1/84* (2013.01); *G10K 11/172* (2013.01)

(58) Field of Classification Search
CPC ..... E04B 1/82; E04B 1/86
USPC ..... 181/290, 284, 286
See application file for complete search history.

(56) References Cited

U.S. PATENT DOCUMENTS

| | | | | |
|---|---|---|---|---|
| 8,469,145 | B2 * | 6/2013 | Nonogi et al. | 181/291 |
| 2007/0137926 | A1 | 6/2007 | Albin, Jr. et al. | |
| 2013/0118831 | A1 * | 5/2013 | Kawai et al. | 181/290 |
| 2014/0144722 | A1 * | 5/2014 | Lee | 181/290 |

(Continued)

FOREIGN PATENT DOCUMENTS

| | | | |
|---|---|---|---|
| EP | 1840287 | A2 | 10/2007 |
| EP | 2181845 | A1 | 5/2010 |
| JP | 07060890 | A | 3/1995 |

(Continued)

OTHER PUBLICATIONS

Korean Office Action for Korean Application No. 10-2012-0073358 mailed on Feb. 25, 2015.

(Continued)

*Primary Examiner* — Forrest M Phillips
(74) *Attorney, Agent, or Firm* — Hauptman Ham, LLP

(57) ABSTRACT

Provided is a sound absorption sheet comprising: a porous substrate; and a micro-resonance layer having a pattern of a plurality of sound-absorbing holes penetrating both surfaces thereof. Also provided is a sound absorbing soundproofing panel, the exterior surface of which is covered with the sound absorption sheet comprising: the porous substrate; and the micro-resonance layer having a pattern of a plurality of sound-absorbing holes penetrating both surfaces thereof.

19 Claims, 8 Drawing Sheets

(56) References Cited

U.S. PATENT DOCUMENTS

| | | | | |
|---|---|---|---|---|
| 2014/0182967 | A1* | 7/2014 | Takeda et al. | 181/290 |
| 2014/0224572 | A1* | 8/2014 | Tsujino | 181/201 |

FOREIGN PATENT DOCUMENTS

| | | | |
|---|---|---|---|
| JP | 2003140659 | A | 5/2003 |
| JP | 2010196421 | A | 9/2010 |
| KR | 20080082210 | A | 9/2008 |
| KR | 20090022753 | A | 3/2009 |
| KR | 20110004418 | A | 1/2011 |
| KR | 101036330 | B1 | 5/2011 |
| KR | 20110065877 | A | 6/2011 |
| KR | 20120024063 | A | 3/2012 |
| WO | 9963169 | A2 | 12/1999 |

OTHER PUBLICATIONS

International Search Report for PCT/KR2013/005580 mailed on Sep. 5, 2013.

Extended European Search Report dated Jan. 18, 2016 in connection with the counterpart European Patent Application No. 13812929.1, citing the above reference(s).

* cited by examiner

INTERIOR SOUND ABSORPTION SHEET AND SOUND ABSORBING SOUND-PROOFING PANEL CONTAINING SAME

TECHNICAL FIELD

The present invention relates to an interior sound absorption sheet and a sound absorption type soundproofing panel including the same.

BACKGROUND ART

As recent improvement in standard of living has led to growing demand for a pleasant life, acoustic design for buildings becomes important. Currently, soundproofing panels having sound absorption capability so as to absorb a variety of interior noise are used as interior materials for buildings. Moreover, a variety of sound absorption sheets and sound absorption type soundproofing panels including the sound absorption sheets are used in fields that require a soundproofing capability, such as interior and exterior materials for car seats.

A sound absorption sheet generally requires permeability and sound absorption capability in order to minimize noise, and requires excellent permeability in order to maximize sound absorption effects. Thus, the sound absorption sheet requires a number of perforations to block noise.

Generally, in order to use a sound absorption material, a surface decorative material is formed on an outer surface of the sound absorption material, thereby causing a problem of severe deterioration in soundproofing or fireproofing performance of the sound absorption material. Korean Patent Publication No. 10-2011-0065877 discloses an acoustic panel system including a perforated sheet formed with plural minute perforations, but does not disclose improvement in decorative performance by realizing a variety of shapes on an external surface of the perforated sheet.

DISCLOSURE

Technical Problem

It is an aspect of the present invention to provide a sound absorption sheet having decorative performance.

It is another aspect of the present invention to provide a sound absorption type soundproofing panel including the sound absorption sheet.

Technical Solution

In accordance with one aspect of the present invention, a sound absorption sheet includes: a porous substrate; and a micro-resonance layer formed with a plurality of patterned sound absorption holes penetrating both surfaces thereof.

The micro-resonance layer formed with the plurality of patterned sound absorption holes may have an embossed pattern.

The embossed pattern may be formed by arranging shapes selected from among a polygonal shape, a circular shape, an oval shape, and combinations thereof.

The embossed pattern may include a stripe pattern.

The sound absorption holes may have a shape selected from among a polygonal shape, a circular shape, an oval shape, and combinations thereof.

The sound absorption holes may include a stripe pattern.

The sound absorption holes may have an average diameter of about 0.1 mm to about 20 mm.

A ratio of the sound absorption holes per unit area may range from about 1% to about 60%.

A pitch between the sound absorption holes may range from about 0.5 mm to about 50 mm.

The micro-resonance layer may have a thickness of about 100 μm to about 1500 μm.

The micro-resonance layer may be formed by printing.

The micro-resonance layer may include at least one selected from among a vinyl chloride sol, a urethane resin, an acrylic resin, and a vinyl resin.

The porous substrate may have an average pore size of about 5 μm to about 50 μm.

The porous substrate may have a porosity of about 30% to about 80%.

In accordance with another aspect of the present invention, there is provided a sound absorption type soundproofing panel, wherein an outer surface of a sound absorbing material is covered with the sound absorption sheet.

The sound absorbing material may include at least one selected from among a porous plate, an organic material, an inorganic material, a natural material, a thermoplastic resin matrix, and a thermosetting resin matrix.

Advantageous Effects

According to one embodiment of the present invention, there is provided an interior sound absorption sheet capable of representing various designs and three-dimensional designs.

According to another embodiment of the present invention, a sound absorption type soundproofing panel includes the sound absorption sheet having sound absorption capacity and air permeability, and has a three-dimensional pattern on an outer surface thereof to provide an aesthetically pleasing appearance, thereby improving interior decoration effects.

BEST MODE

Hereinafter, embodiments of the present invention will be described in detail with reference to the accompanying drawings. It should be understood that the following embodiments are provided for illustration only and are not to be construed in any way as limiting the present invention. The scope and sprit of the present invention should be defined only by the accompanying claims and equivalents thereof.

Sound Absorption Sheet

One embodiment of the present invention provides a sound absorption sheet, which includes: a porous substrate and a micro-resonance layer formed with a plurality of patterned sound absorption holes.

Figure 1:
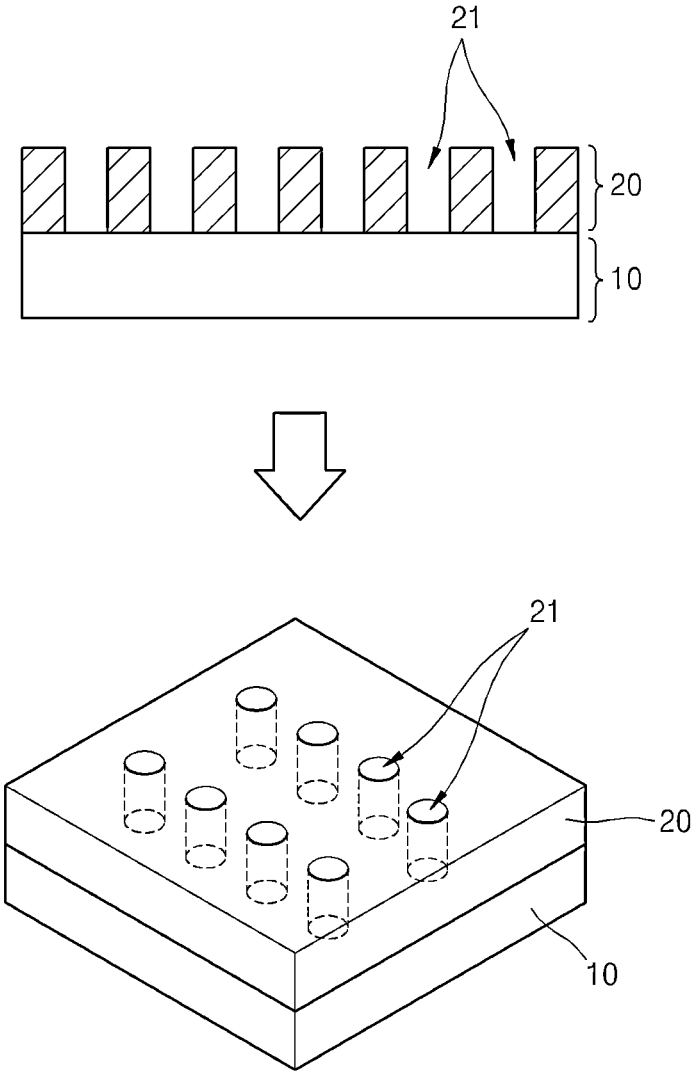
FIG. 1 is a side view of a sound absorption sheet according to one embodiment of the present invention.
Figure 2:
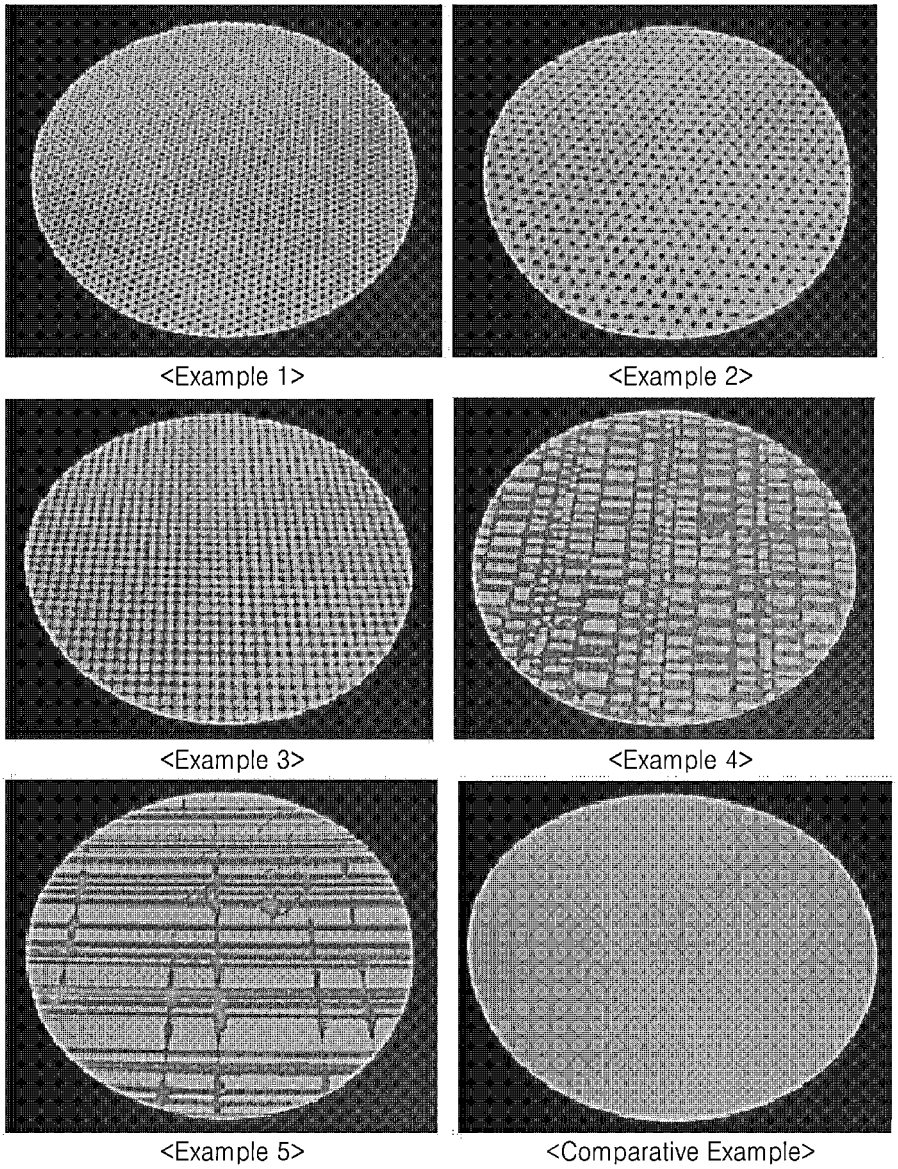
FIG. 2 is pictures showing external appearances of sound absorption sheets prepared in Examples 1 to 5 and Comparative Example 1.
Figure 3:
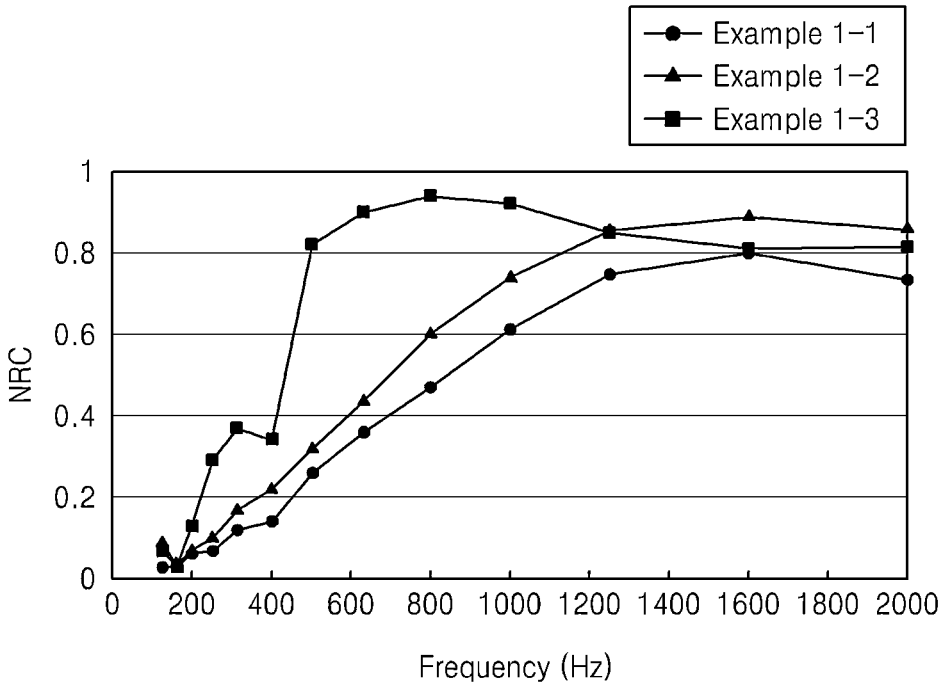
FIGS. 3 to 7 are a graph depicting NRC according to frequency in Examples 1 to 5.
Figure 4:
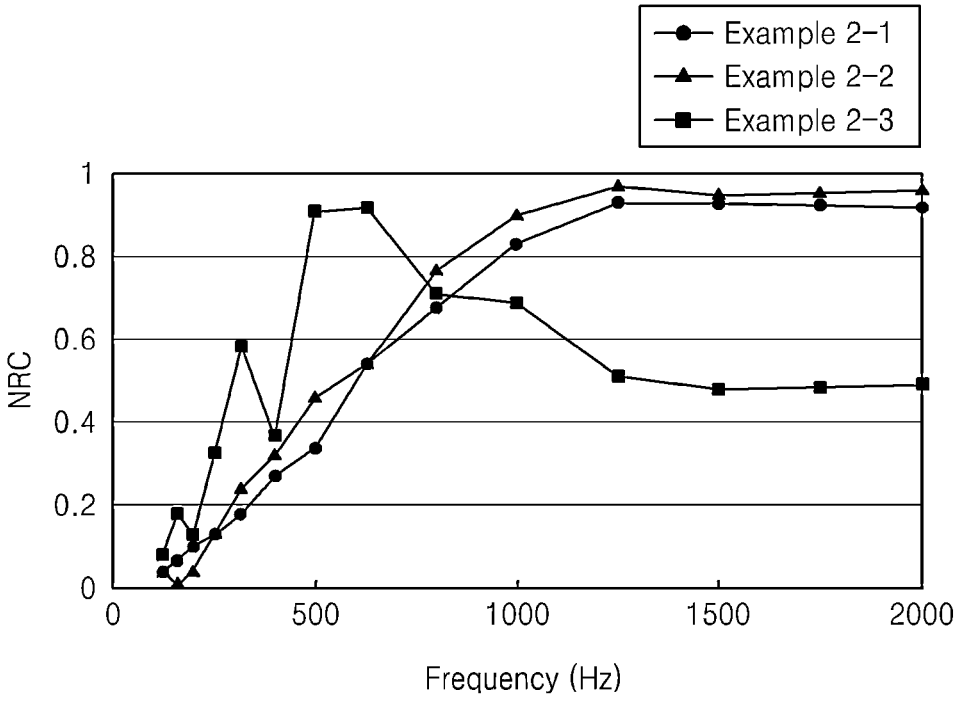
Figure 5:
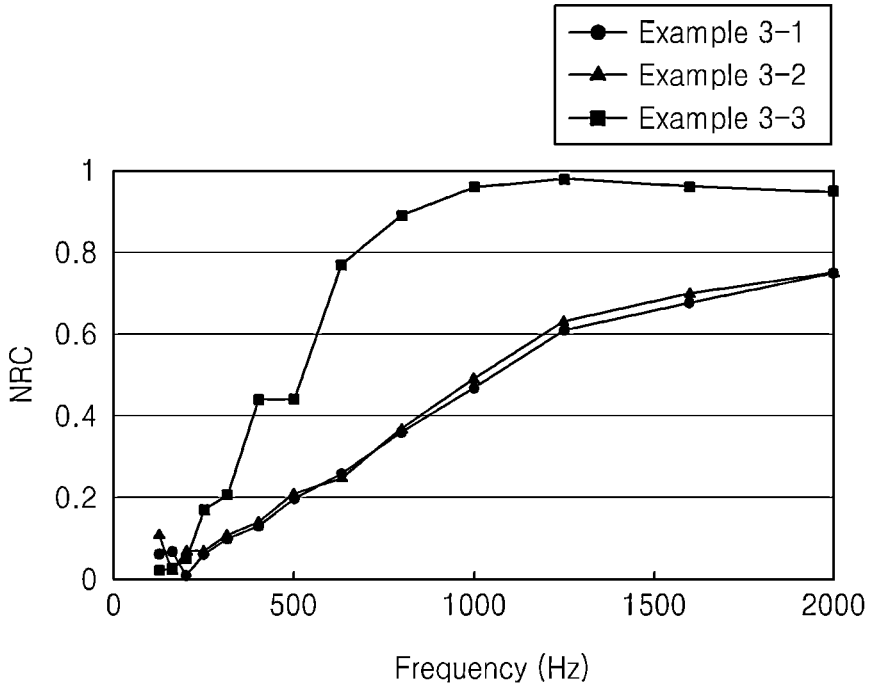
Figure 6:
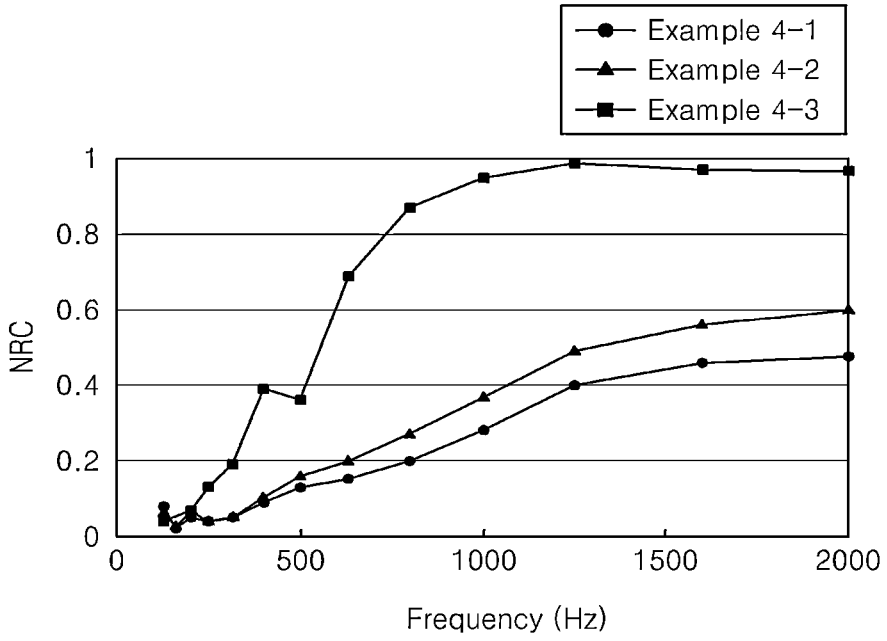
Figure 7:
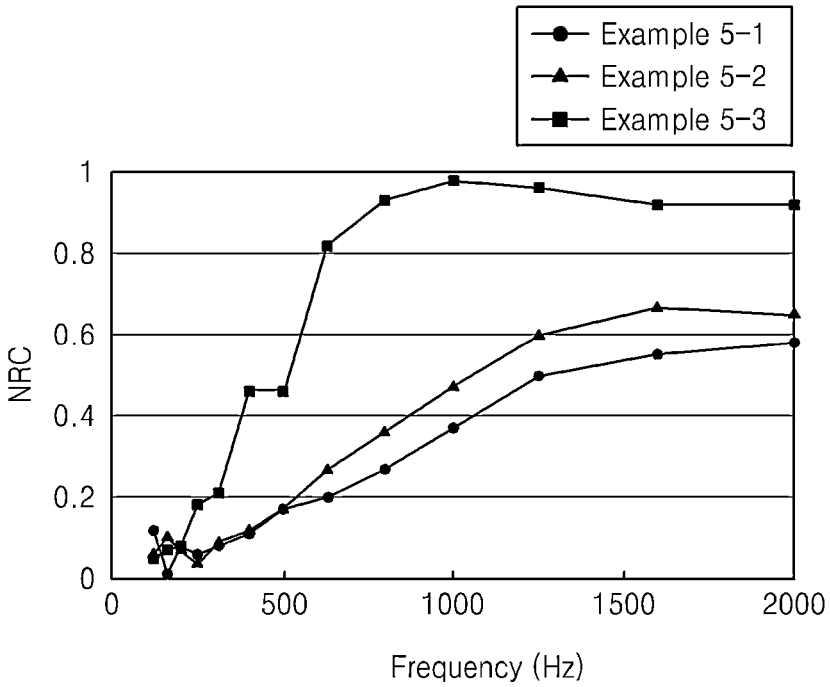
Figure 8:
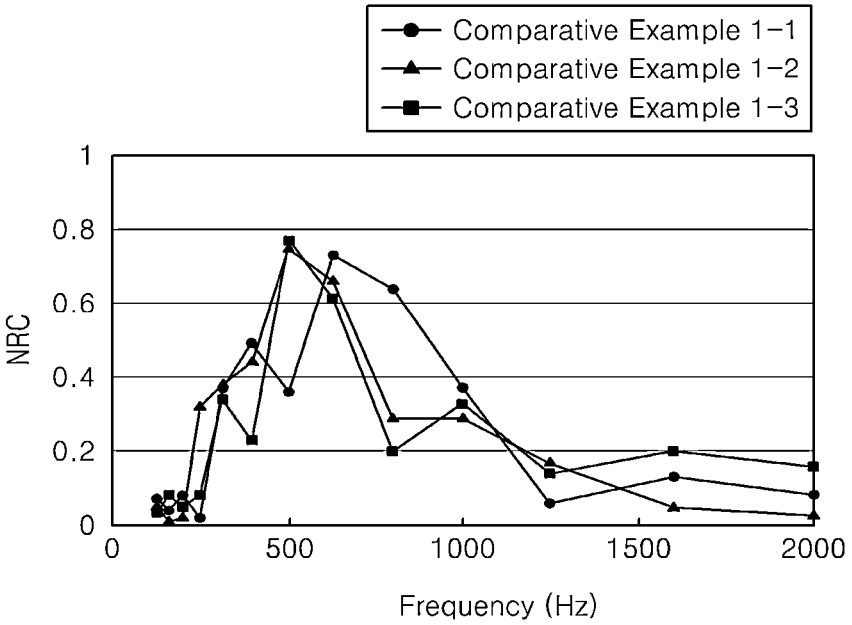
FIG. 8 is a graph depicting NRC according to frequency in Comparative Example 1.

Referring to FIG. 1, a sound absorption sheet 100 according to one embodiment of the invention may include a porous substrate 10 and a micro-resonance layer formed with a plurality of patterned sound absorption holes 21 penetrating both surfaces thereof.

Due to an inherent porous structure of the substrate, the porous substrate 10 can affect sound absorption properties in high frequency bands or can maintain sound absorption capability of a sound absorption material. The porous substrate 10 may include at least one selected from among glass fibers, cellulose fibers, pulps, and synthetic organic fibers.

The glass fibers are formed by melting glass, which includes $SiO_2$ as a main component, followed by processing the molten glass into fibers. According to a manufacturing method and usage, the glass fibers are categorized into long fibers and short fibers. As the glass fibers have a thinner diameter, the glass fibers exhibit better properties in terms of tensile strength and thermal conductivity. For heat reservation/sound absorption, glass fibers having a diameter of about 5 μm to about 20 μm are generally used. For filtering, fibers having a diameter of about 40 μm to about 150 μm are generally used.

The cellulose fibers are generally categorized into natural fibers and other fibers prepared using the natural fibers as a raw material. Typically, the cellulose fibers include wood fibers, cotton fibers, hemp fibers, Rayon, and the like. The cellulose fibers generally take the form of woven fabrics or knitted fabrics. In addition, the cellulose fibers may be used in a mixed form with other synthetic fibers, such as polyesters. Textile products prepared using a mixture of the cellulose fibers and synthetic fibers may be provided in the form of mixed yarns, mixed woven fabrics, mixture fabrics or knitted fabrics.

The pulp is an aggregate of cellulose fibers obtained from wood or other fiber plants through a mechanical process, a chemical process, or a combination thereof. The substrate may be prepared by compressing and bonding the pulp. The synthetic organic fibers may be selected from among polyester, polyethylene (PE), polypropylene (PP), ethylene-styrene copolymer (ES), cycloolefin, polyethylene terephthalate (PET), polyvinyl alcohol (PVA), ethylene-vinyl acetate (EVA), polyethylene naphthalate (PEN), polyether ether ketone (PEEK), polycarbonate (PC), polysulfone, polyimide (PI), polyacrylonitrile (PAN), styreneacrylonitrile (SAN), and polyurethane (PU). Specifically, the synthetic organic fibers may be composed of PVA.

More specifically, the porous substrate may be formed of a mixture of glass fibers and pulp and may be prepared in the form of paper. Examples of commercially available products may include GP-50G of Hankuk Carbon Co., Ltd. (basis weight of 50 $g/m^2$, which may be controlled as needed), without being limited thereto.

The porous substrate 10 may have an average pore size of about 5 μm to about 50 μm. The average pore size refers to an average diameter of pores included in the porous substrate. Where the average pore size of the porous substrate is less than about 5 μm, air permeability becomes insufficient, thereby causing deterioration in sound absorption capability. Where the average pore size of the porous substrate exceeds 50 μm, it can be difficult to coat the micro-resonance layer on the top of the porous substrate or to coat the composition upon printing, since the composition passes through the micro-resonance layer.

In addition, the porous substrate 10 may have a porosity of about 30% to about 80%. The porosity represents a volume of pores inside the porous substrate relative to the total volume of the porous substrate by percent. By maintaining the porosity of the porous substrate within this range, it is possible to prevent deterioration in sound absorption capability due to insufficient air permeability or excessive air permeability.

The micro-resonance layer 20 may be formed on top of the porous substrate 10 by printing. As the sound absorption sheet according to the embodiment of the invention includes the micro-resonance layer, the sound absorption sheet has a resonator structure for efficiently reducing noise. In addition, since the micro-resonance layer is formed on the top of the porous substrate, the sound absorption sheet has further improved sound absorption capability in terms of sound and noise absorption due to the pores included in the porous substrate and the sound absorption holes included in the micro-resonance layer.

Specifically, the micro-resonance layer 20 is formed by rotary screen printing. Rotary screen printing is simple and easy, thereby reducing manufacturing costs. In addition, rotary screen printing can secure sound absorption and soundproofing effects, and allows a production speed of 20 m/min to be maintained, thereby enabling mass production of the sound absorption sheet.

Unlike typical methods having limitation in size and ratio of the perforations formed in the micro-resonance layer by punching, drilling, laser processing, etching, and the like, according to the embodiment of the present invention, the micro-resonance layer including the plurality of sound absorption holes is formed by printing. Thus, since it is possible to control the diameter of the sound absorption holes, the ratio of the sound absorption holes per unit area, and a pitch between the sound absorption holes, the micro-resonance layer can include a greater number of sound absorption holes per unit area, and thus provide an excellent resonator structure.

More specifically, rotary-screen printing includes injecting a composition for forming a micro-resonance layer into a rotary screen roll, which may include a micro-sound absorption screen. More specifically, a porous substrate is passed through a gap between a back roll and a rotary screen roll, and a plurality of sound absorption holes is formed on the top of the porous substrate, thereby forming a micro-resonance layer having a resonator structure.

In order to maintain the resonator structure, the micro-resonance layer 20 may include a plurality of sound absorption holes 21 penetrating both surfaces thereof. Here, the sound absorption sheet includes the plurality of sound absorption holes, thereby providing not only a soundproofing function but also an additional function of preventing vibration by absorbing noise.

The micro-resonance layer 20 may have a thickness of about 100 μm to 1500 μm. Within this thickness range of the micro-resonance layer 20, the plurality of sound absorption holes can maximize resonance effects, thereby providing sound absorption capability.

The micro-resonance layer may be formed using almost all kinds of polymers. The micro-resonance layer may be formed of a thermoplastic resin undergoing cross-linking reaction by heat, or may be formed of foam. In some embodiments, the material for forming the micro-resonance layer may further include a plasticizer, a stabilizer, fillers, a curing catalyst, a cross-linking agent, a binder, a flame retardant, and the like. A specific example of the thermoplastic resin may include at least one selected from among a vinyl chloride sol, a urethane resin, an acryl resin, a vinyl resin, and the like.

An embossed pattern may be provided to the micro-resonance layer formed with the plurality of patterned sound absorption holes. Here, the embossed pattern is formed by arranging shapes selected from among a polygonal shape, a circular shape, an oval shape, and combinations thereof, and is not limited to a circular shape. In addition, the embossed pattern may also include a stripe pattern, and may be formed by continuously repeating shapes selected from among a polygonal shape, a circular shape, an oval shape, and combinations thereof.

Since the micro-resonance layer 20 having such an embossed pattern is formed on the surface of the porous substrate 10, the sound absorption sheet 100 can impart various appearances to the surfaces of the sound absorption sheet and panel. In addition, since the plurality of sound absorption holes 21 is formed by printing, the sound absorption sheet 100 can secure flame resistance while maintaining constant air permeability and noise reduction coefficient.

Like the embossed pattern having various shapes, the sound absorption hole 21 may have a shape selected from among a polygonal shape, a circular shape, an oval shape, and combinations thereof, without being limited thereto. The sound absorption holes may have various shapes according to the shape of the embossed pattern and may also have a stripe pattern.

The sound absorption holes may have an average diameter of about 0.1 mm to about 20 mm Here, the average diameter refers to an average diameter of the sound absorption holes penetrating both surfaces of the micro-resonance layer, and there is no limitation as to the shape of the sound absorption holes. According to the embossed pattern of the micro-resonance layer, the shape of the sound absorption holes may vary. The average diameter of the sound absorption holes may refer to a diameter of a circle in the case where the sound absorption holes have a circular shape in plan view, a length of one side where the sound absorption holes have a rectangular shape in plan view, and a width of a stripe in the case where the sound absorption holes have a stripe shape in plan view.

The ratio of the sound absorption hole 21 per unit area may range from about 1% to about 60%. This ratio is obtained by dividing an area occupied by the sound absorption holes per unit area, specifically an area occupied by the plurality of sound absorption holes penetrating both surfaces of the micro-resonance layer, by the unit area. By maintaining the ratio within this range, the micro-resonance layer including the sound absorption holes can improve sound absorption capability in both high frequency bands and low frequency bands.

In addition, a distance between the sound absorption holes 21 may range from about 0.5 mm to about 50 mm. The distance between the sound absorption holes 21 is also referred to as pitch and means a distance from the center of one sound absorption hole to the center of another sound absorption hole closest thereto, regardless of the shape of the sound absorption holes. By maintaining the pitch within this range, the micro-resonance layer including the sound absorption holes can improve sound absorption capability in both high frequency bands and low frequency bands.

The sound absorption sheet may be used in a variety of fields to absorb sound and noise. For example, the sound absorption sheet may be used as a sound absorption panel for buildings and interior decoration, and interior and exterior materials for vehicles, specifically to absorb sound and noise from an engine compartment of the vehicles. In addition, the sound absorption sheet may also be applied to electric and electronic equipment. The weight and manufacturing costs of the sound absorption sheet increase with increasing thickness of the sound absorption sheet. Thus, the thickness and weight of the sound absorption sheet may be suitably controlled in order to reduce the size and manufacturing costs of equipment or products employing the sound absorption sheet.

Sound Absorption Type Soundproofing Panel

Another embodiment of the present invention provides a sound absorption type soundproofing panel, wherein an outer surface of a sound absorbing material is covered with a sound absorption sheet, which includes: a porous substrate; and a micro-resonance layer formed with a plurality of patterned sound absorption holes penetrating both surfaces thereof. For example, the sound absorption type soundproofing panel may be manufactured by applying an adhesive to a sound absorption panel and then bonding the sound absorption sheet to the sound absorption panel, followed by drying.

The sound absorption type soundproofing panel has a soundproofing function and provides additional functions to prevent vibration by absorbing sound generated inside the panel. The sound absorbing material may include any material capable of attenuating sound reflection by absorbing sound waves incident on a medium.

The sound absorption material of the sound absorption type soundproofing panel may include at least one selected from among a porous plate, an organic material, an inorganic material, a natural material, a thermoplastic resin matrix, and a thermosetting resin matrix. For example, the porous plate may include polyester, glass fiber, polystyrene, melamine, wood wool boards, and the like. The natural material may include hemp fibers, natural fibers, and the like. The thermoplastic resin may include polyvinyl chloride (PVC), polyethylene (PE), low density polyethylene (LDPE), high density polyethylene (HDPE), polypropylene (PP), polystyrene (PS), acrylonitrile-butadiene-styrene (ABS), polyamide (PA: nylon), polyethylene terephthalate (PET), and the like. In addition, cork board, aluminum foam, plaster board, and the like may also be used as the sound absorption materials. There are no restrictions as to the kinds of sound absorption materials.

Since the sound absorption type soundproofing panel reduces resonance of a microphone and clearly transmits speaker sound, the soundproofing panel may be used as interior materials for lecture rooms, conference rooms, and Karaoke rooms equipped with electric acoustic systems, without being limited thereto.

Since the sound absorption sheet includes the plurality of sound absorption holes, the sound absorption type soundproofing panel can maximize efficiency of absorbing sound waves from the sound absorbing material. In addition, since the plural sound absorption holes are formed by printing, specifically by screen-printing, the plurality of sound absorption holes provides excellent sound absorption and soundproofing effects. Further, the plurality of sound absorption holes may be arranged in a variety of three-dimensional patterns to provide an aesthetically pleasing appearance, thereby improving interior decoration effects.

Hereinafter, the present invention will be described in more detail with reference to some examples. It should be understood that these examples are provided for illustration only and are not to be construed in any way as limiting the present invention.

PREPARATIVE EXAMPLE

A porous substrate was prepared in the form of a glass paper sheet using a mixture of 40% of glass fibers having a fiber diameter of about 5 μm to about 20 μm and a fiber length of about 1 mm to about 50 mm, 55% of pulp, and 5% of PET fibers, and a micro-resonance layer was formed on top of the porous substrate by rotary screen printing. At this time, the porous substrate passes through between a rotary screen roll into which PVC sol is injected and a back roll. Then, the porous substrate was passed through a gap between a back roll and a rotary screen roll to which a PVC sol was injected. As the PVC sol passed through a micro-sound absorption screen in the rotary screen, a micro-resonance layer formed with a plurality of sound absorption holes penetrating both surfaces thereof was printed on the top of the porous substrate, thereby manufacturing a sound absorption sheet.

EXAMPLES AND COMPARATIVE EXAMPLES

Sound absorption sheets were prepared in Examples 1 to 5 by controlling the basis weight of the porous substrate, the shape and average diameter of the sound absorption holes included in the micro-resonance layer, the pitch between the sound absorption holes, and the ratio of the sound absorption holes per unit area.

In addition, a sound absorption sheet of Comparative Example 1 was prepared in the same manner as in Preparative Example except that a PVC sol was deposited on the top of the porous substrate in a conventional manner and the sheet did not include a micro-resonance layer.

TABLE 1

| | | | Micro-resonance layer | | | | |
|---|---|---|---|---|---|---|---|
| | | Porous substrate Basis weight ($g/m^2$) | Shape of embossed pattern | Shape of sound absorption hole | Average diameter of sound absorption hole (mm) | Pitch between sound absorption holes (mm) | Ratio of sound absorption holes per unit of area (%) |
| Example 1 | 1-1 | 50 | Polygon | Dot | 0.7 | 2 | 11.12 |
| | 1-2 | 70 | Polygon | Dot | 0.7 | 2 | 11.12 |
| | 1-3 | 80 | Polygon | Dot | 0.7 | 2 | 11.12 |
| Example 2 | 2-1 | 50 | Polygon | Dot | 1.5 | 4 | 12.75 |
| | 2-2 | 70 | Polygon | Dot | 1.5 | 4 | 12.75 |
| | 2-3 | 80 | Polygon | Dot | 1.5 | 4 | 12.75 |
| Example 3 | 3-1 | 50 | Dot | Dot | 2 | 4 | 21.46 |
| | 3-2 | 70 | Dot | Dot | 2 | 4 | 21.46 |
| | 3-3 | 80 | Dot | Dot | 2 | 4 | 21.46 |
| Example 4 | 4-1 | 50 | Tetragon | Tetragon | 15.8 | 10 | 58.16 |
| | 4-2 | 70 | Tetragon | Tetragon | 15.8 | 10 | 58.16 |
| | 4-3 | 80 | Tetragon | Tetragon | 15.8 | 10 | 58.16 |
| Example 5 | 5-1 | 50 | Stripe | Stripe | 4 (stripe width) | 8 | 37.5 |
| | 5-2 | 70 | Stripe | Stripe | 4 (stripe width) | 8 | 37.5 |
| | 5-3 | 80 | Stripe | Stripe | 4 (stripe width) | 8 | 37.5 |
| Comparative Example 1 | 1-1 | 50 | — | — | — | — | 0 |
| | 1-2 | 70 | — | — | — | — | 0 |
| | 1-3 | 80 | — | — | — | — | 0 |

EXPERIMENTAL EXAMPLE

Measurement of average NRC of sound absorption sheet

I. Test method

1. Test: pipe method (KS F 2814)
2. Test device (Device Name: Model name (manufacturer/country) Pipe method: HM-02 I/O (Scein/S. Korea)
3. Test temperature/humidity: (19.4, tolerance of 0.3)° C./(59.4, tolerance of 1.9)% R.H.

The pipe method is a method of measuring an NRC of a sound absorbing material by measuring a standing wave when a plane wave is normally incident in a certain direction. This method is also a simple method that can be performed in the case where it is not easy to obtain a specimen. After preparing a specimen having an accurate size, measurement is repeated, thereby minimizing measurement error.

$$NRC=(a250+a500+a1,000+a2,000)/4 \quad \text{<Equation>}$$

aX: NRC of XHz (X is a numeral),

Here, since a material has different sound absorption coefficients according to frequency, a single index of sound absorption coefficient representing the material is required in order to indicate sound absorption capability of the material. An NRC (Noise Reduction Coefficient) is a single index to represent a sound absorption coefficient of a material. In this experimental example, a frequency to the number of vibration was measured with a back space set to 50 mm

TABLE 2

| | | Thickness of sound absorption sheet (mm) | Pore transmittance of sound absorption sheet (L/m2/s) at 100 Pa | Average NRC of sound absorption sheet |
|---|---|---|---|---|
| Example 1 | 1-1 | 0.67 | 500 | 0.36 |
| | 1-2 | 0.83 | 367 | 0.44 |
| | 1-3 | 0.85 | 193 | 0.64 |

TABLE 2-continued

| | | Thickness of sound absorption sheet (mm) | Pore transmittance of sound absorption sheet (L/m2/s) at 100 Pa | Average NRC of sound absorption sheet |
|---|---|---|---|---|
| Example 2 | 2-1 | 0.65 | 273 | 0.49 |
| | 2-2 | 0.76 | 253 | 0.53 |
| | 2-3 | 0.75 | 133 | 0.56 |
| Example 3 | 3-1 | 0.7 | Impossible to measure | 0.2 |
| | 3-2 | 0.71 | Impossible to measure | 0.3 |
| | 3-3 | 0.75 | 173 | 0.59 |
| Example 4 | 4-1 | 0.65 | Impossible to measure | 0.185 |
| | 4-2 | 0.69 | Impossible to measure | 0.231 |
| | 4-3 | 0.74 | 180 | 0.561 |
| Example 5 | 5-1 | 0.67 | Impossible to measure | 0.24 |
| | 5-2 | 0.73 | Impossible to measure | 0.29 |
| | 5-3 | 0.78 | 147 | 0.6 |
| Comparative | 1-1 | 0.64 | 0 | 0.28 |
| Example 1 | 1-2 | 0.74 | 0 | 0.29 |

Table 2 shows measurement results of thicknesses, air permeability values (KS K 0570: 2006 test method), and average NRCs of the sound absorption sheets prepared in Examples 1 to 5 and Comparative Example 1.

In Examples 1 to 5, the sound absorption sheets maintained air permeability in the range of about 50 L/m$^2$/s to about 1000 L/m$^2$/s at a pressure of 100 Pa. It can be seen that, even though the sound absorption sheets had decorative performance by diversifying the shape of the embossed pattern, the sound absorption sheets could maintain sound absorption capability. Specifically, in Examples 3-1, 3-2, 4-1, 4-2, 5-1 and 5-2, it was difficult to measure the air permeability since the pressure could not reach 100 Pa due to too high air permeability. Conversely, in Comparative Example, the sound absorption sheet had no sound absorption hole and thus could not have air permeability as indicated by 0, thereby failing to secure sound absorption capability.

The NRC ranges from 0 to 1. As the NRC approaches 1, the sound absorption sheet exhibits better sound absorption capacity. Generally, a sound absorption material has an NRC of about 0.3. In the case where a certain material has an NRC of about 0.4 or more, it can be accepted that the material has excellent sound absorption capacity. In Examples 1 to 5, in which the sound absorption sheet had air permeability in certain levels, the sound absorption sheets generally had an average NRC of 0.4 or more. In Comparative Example 1, the sound absorption sheets had an average NRC of 0.2 or less. Thus, it could be seen that the sound absorption sheets including various embossed patterns had higher average NRCs.

Specifically, when the porous substrate had a basis weight of 80 g/m$^2$, most sound absorption sheets had an average NRC approaching 0.6. Accordingly, it could be seen that excellent sound absorption capability can be achieved by rotary printing even when the embossed pattern having various shapes was formed.

Generally, low air permeability can cause insufficient sound absorption. From the experimental results, it can be seen that the sound absorption sheet including an embossed pattern of various shapes secures excellent sound absorption capability. Decorative effects can be achieved by changing the shape of the embossed pattern. Thus, the embodiment of the present invention can provide an interior sound absorption sheet having sound absorption capability.

The invention claimed is:

1. A sound absorption sheet comprising:

a porous substrate; and a micro-resonance layer formed with a plurality of patterned sound absorption holes penetrating both surfaces thereof, wherein the porous substrate comprises glass fibers, wherein the glass fibers have a fiber diameter of 5 μm to 20 μm and a fiber length of 1 mm to 50 mm, and wherein the porous substrate has a basis weight of 50~80 g/m$^2$.

2. The sound absorption sheet according to claim 1, wherein the micro-resonance layer formed with the plurality of patterned sound absorption holes has an embossed pattern.

3. The sound absorption sheet according to claim 2, wherein the embossed pattern is formed by arranging shapes selected from among a polygonal shape, a circular shape, an oval shape, and combinations thereof.

4. The sound absorption sheet according to claim 2, wherein the embossed pattern comprises a stripe pattern.

5. The sound absorption sheet according to claim 1, wherein the sound absorption holes have a shape selected from among a polygonal shape, a circular shape, an oval shape, and combinations thereof.

6. The sound absorption sheet according to claim 1, wherein the sound absorption holes comprise a stripe pattern.

7. The sound absorption sheet according to claim 1, wherein the sound absorption holes have an average diameter of 0.1 mm to 20 mm.

8. The sound absorption sheet according to claim 1, wherein a ratio of the sound absorption holes per unit area ranges from 1% to 60%.

9. The sound absorption sheet according to claim 1, wherein a pitch between sound absorption holes ranges from 0.5 mm to 50 mm.

10. The sound absorption sheet according to claim 1, wherein the micro-resonance layer has a thickness of 100 μm to 1500 μm.

11. The sound absorption sheet according to claim 1, wherein the micro-resonance layer is formed by printing.

12. The sound absorption sheet according to claim 1, wherein the micro-resonance layer comprises at least one selected from among a vinyl chloride sol, a urethane resin, an acrylic resin, and a vinyl resin.

13. The sound absorption sheet according to claim 1, wherein the porous substrate has an average pore size of 5 μm to 50 μm.

14. The sound absorption sheet according to claim 1, wherein the porous substrate has a porosity of 30% to 80%.

15. A sound absorption type soundproofing panel including the sound absorption sheet according to claim 1, wherein an outer surface of a sound absorbing material is covered with the sound absorption sheet.

16. The sound absorption type soundproofing panel according to claim 15, wherein the sound absorbing material includes at least one selected from among a porous plate, an organic material, an inorganic material, a natural material, a thermoplastic resin matrix, and a thermosetting resin matrix.

17. The sound absorption sheet according to claim 1, wherein the cellulose fibers are pulp, and the synthetic organic fibers are PET.

18. The sound absorption sheet according to claim 1, wherein the porous substrate comprises 40% of glass fibers, 55% of pulp, and 5% of PET fibers.

19. A sound absorption sheet comprising:

a porous substrate; and a micro-resonance layer formed with a plurality of patterned sound absorption holes penetrating both surfaces thereof, wherein the porous substrate comprises glass fibers, and at least one of cellulose fibers or synthetic organic fibers.

* * * * *